US006350154B1

(12) United States Patent
Fu

(10) Patent No.: US 6,350,154 B1
(45) Date of Patent: Feb. 26, 2002

(54) ADAPTER FOR CONNECTOR

(76) Inventor: Huang Long Fu, 3Fl., No. 492-19, Sec.1 Wan-Shou Rd., Tao-Yuan Hsien (TW)

( * ) Notice: Subject to any disclaimer, the term of this patent is extended or adjusted under 35 U.S.C. 154(b) by 0 days.

(21) Appl. No.: 09/565,408

(22) Filed: May 4, 2000

(30) Foreign Application Priority Data

Sep. 18, 1999 (TW) ..... 88216022

(51) Int. Cl.[7] ..... H01R 33/90
(52) U.S. Cl. ..... 439/638; 439/31
(58) Field of Search ..... 439/638, 224, 439/31, 954, 654, 751, 733.1

(56) References Cited

U.S. PATENT DOCUMENTS 4,632,475 A * 12/1986 Tomita ..... 439/31
4,877,409 A * 10/1989 Tanigawa et al. ..... 439/31
4,966,557 A * 10/1990 Barkus et al. ..... 439/246
4,975,062 A * 12/1990 Evans et al. ..... 439/13
6,095,839 A * 8/2000 Kline ..... 439/224

* cited by examiner

*Primary Examiner*—Gary Paumen
*Assistant Examiner*—Ross Gushi

(57) ABSTRACT

An adapter for connector of hard disk drive/CD-ROM drive attached to board connector of main board is provided equally spaced first plates are protruded in front of adapter corresponding to the holes of drive connector of hard disk drive/CD-ROM drive in the rear. Two identical first terminals in a stack configuration are received in the spacing of two adjacent first plates. First terminal has a protruded insertion portion. Board connector of main board has open sides to form an L-shaped section. Equally spaced second plates corresponding to first plates are provided in the recessed portion of board connector of main board. Adapter can attach to board connector of main board and move in a range of 90 degrees with respect to board connector of main board after attached. This facilitates the convenience of assembly.

5 Claims, 4 Drawing Sheets

ADAPTER FOR CONNECTOR

FIELD OF THE INVENTION

The present invention relates to connector and more particularly to an adapter for connector of hard disk drive/CD-ROM drive attached to board connector of main board.

BACKGROUND OF THE INVENTION

Conventionally, the internal space of notebook computer or any of other portable computers is limited. As such, there is little spacing or even no spacing between components. This means that typical connectors of desktop personal computer are not suitable to be employed as a means to connect main board and hard disk drive/CD-ROM drive of, for example, notebook computer. As such, there is an adapter commercially available as shown in FIG. 1. This adapter A1 is fixed to drive connector of hard disk drive/CD-ROM drive A having a protruded rectangular frame A11 and a plurality of pins A12 provided in the frame A11. Correspondingly, a board connector B1 is provided on main board B also having a protruded rectangular frame B11 and a plurality of pins B12 provided in the frame B11. As such, adapter A1 may insert into frame B11 of connector B1 to attach pins A12 and B12 together. But this is unsatisfactory for the purpose for which the present invention is concerned for the following reasons:

1. The opening of frame B11 is fixed toward a predetermined direction with respect to main board B. This means that hard disk drive/CD-ROM drive A may only attach to main board B in that predetermined direction. An alignment between hard disk drive/CD-ROM drive A and main board B is required. In view of foregoing, this attaching process is time consuming. Further, no movement of hard disk drive/CD-ROM drive A with respect to main board B is possible once secured. This is not convenient to the installation.
2. The pin-based attachment has the drawbacks of small contact areas between pins A12 and B12, poor conductivity, and pins susceptible to bend which in turn increases contact resistance, thereby degrading the conductivity.

Thus, it is desirable to provide an adapter for connector in order to overcome the above drawbacks of prior art.

SUMMARY OF THE INVENTION

It is therefore an object of the present invention to provide an adapter for connector of hard disk drive/CD-ROM drive attached to board connector of main board wherein board connector of main board is open to two adjacent sides and both terminals of adapter for connector of hard disk drive/CD-ROM drive and board connector of main board have piece-like shapes such that adapter for connector of hard disk drive/CD-ROM drive can be attached in a range of about 90 degrees with respect to board connector of main board. Further, adapter for connector of hard disk drive/CD-ROM drive still can move with respect to board connector of main board within above range after attached. This facilitates the convenience of attachment.

It is another object of the present invention to provide an adapter for connector of hard disk drive/CD-ROM drive attached to board connector of main board wherein the piece-like terminals of adapter for connector of hard disk drive/CD-ROM drive and board connector of main board have relatively large contact areas not liable to be deformed and contact of terminals of adapter for connector of hard disk drive/CD-ROM drive and board connector of main board is implemented in a resiliently biased raised point. This has the benefits of a secure engagement, a better conductivity, and a high quality data transmission.

It is still another object of the present invention to provide an adapter for connector of hard disk drive/CD-ROM drive attached to board connector of main board wherein adapter may move in a range of about 90 degrees with respect to board connector of main board after attached. This facilitates installation, resulting in a reduction in the manufacturing and maintenance costs.

The above and other objects, features and advantages of the present invention will become apparent from drive the following detailed description taken with the accompanying drawings.

DETAILED DESCRIPTION OF PREFERRED EMBODIMENTS

Figure 1:
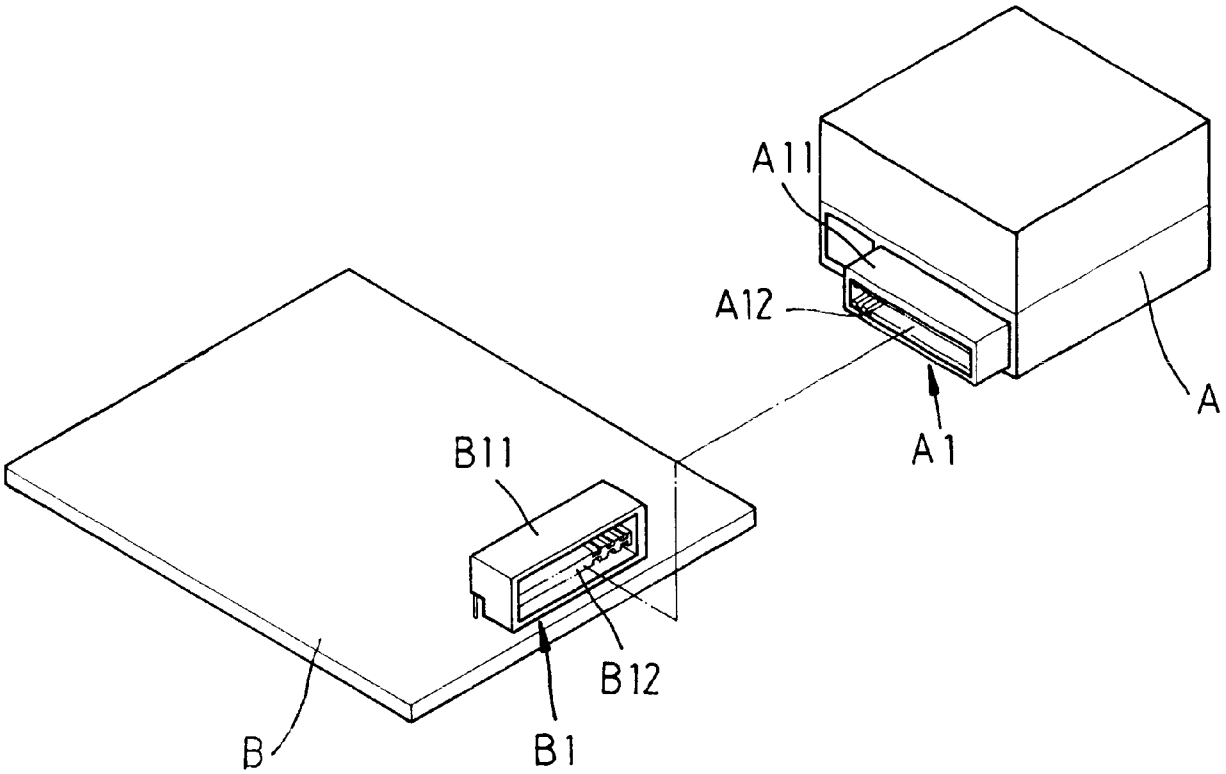
Fig. 1 PRIOR ART
FIG. 1 is a perspective view illustrating the attachment of adapter for connector of hard disk drive/CD-ROM drive and board connector of main board in a conventional technique.
Figure 2A:
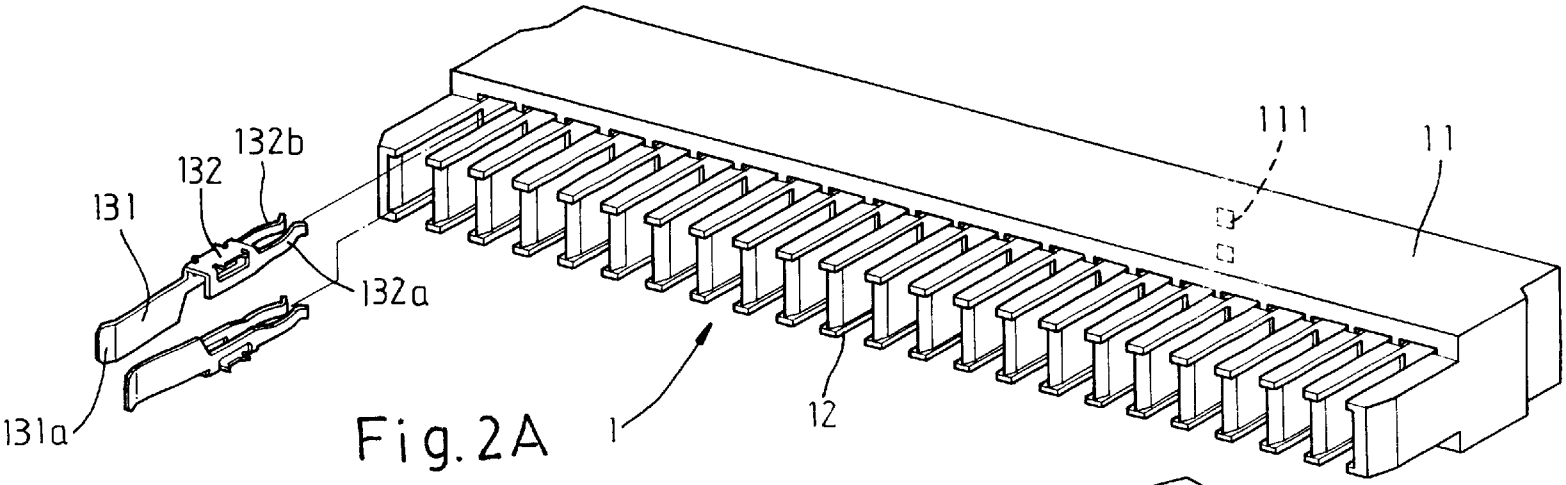
FIG. 2A is an exploded view of adapter for connector of hard disk drive/CD-ROM drive according to the invention.
Figure 2B:
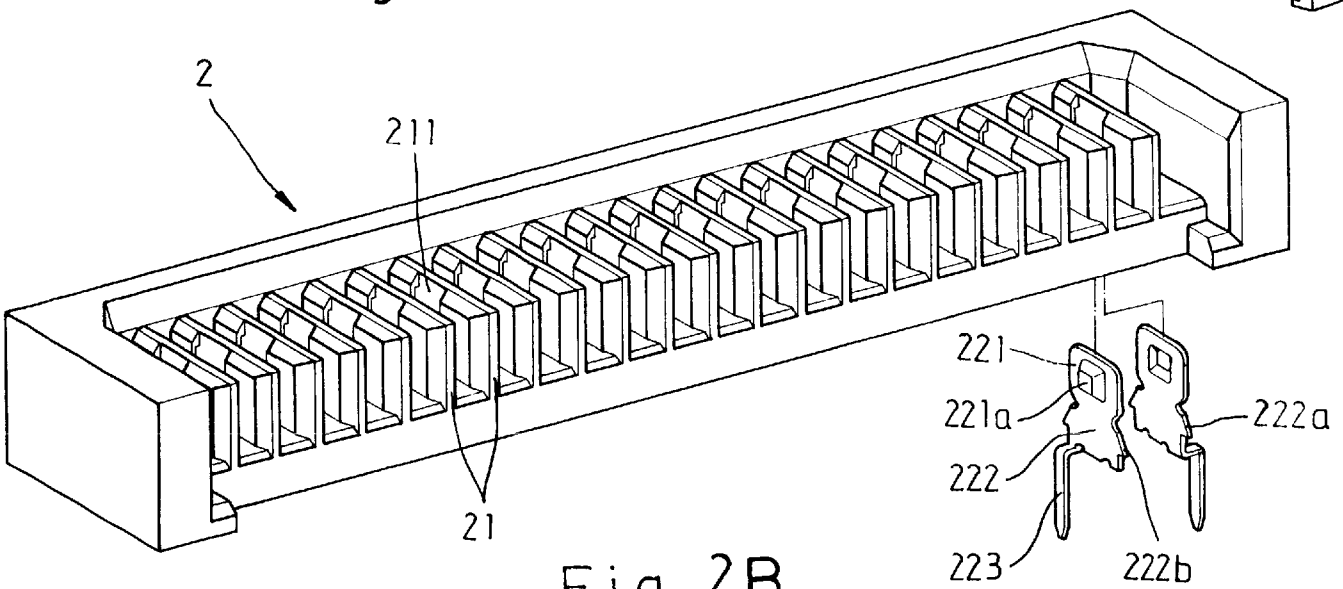
FIG. 2B is an exploded view of board connector of main board according to the invention.
Figure 3:
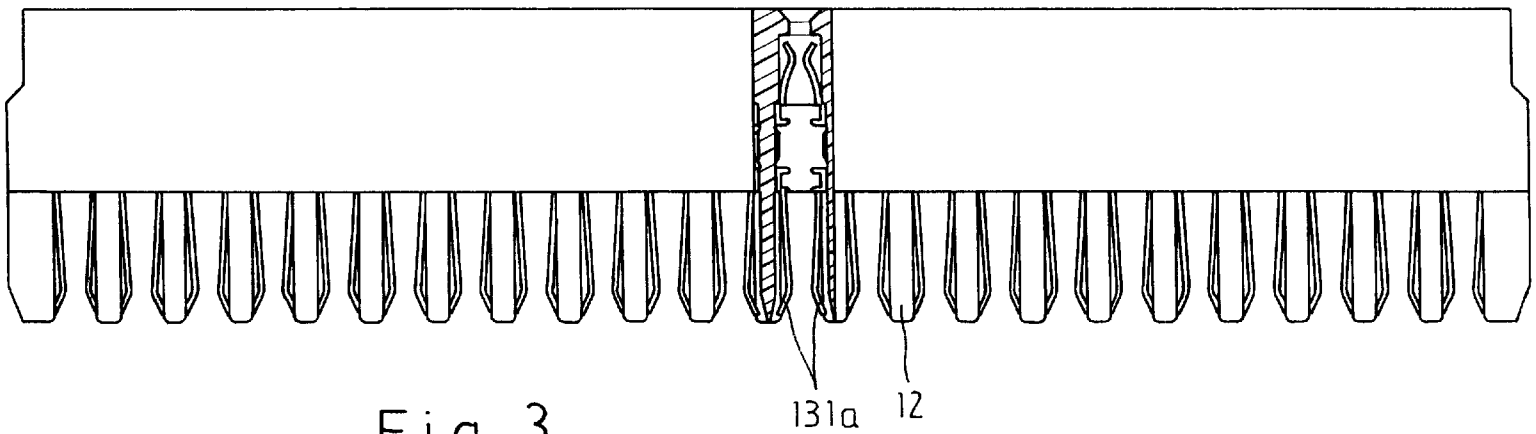
FIG. 3 is a top plan view of adapter for connector of hard disk drive/CD-ROM drive shown in FIG. 2A.

Referring to FIGS. 2A, 2B, 3, and 4, there is shown an adapter 1 for connector of hard disk drive/CD-ROM drive and connector 2 of main board constructed in accordance with the present invention. The rear side of adapter 1 is a typical drive connector 11 of hard disk drive/CD-ROM drive with two rows of holes 111. A plurality of equally spaced apart separation plates 12 are protruded in front side of adapter 1. Each separation plate 12 is I-shaped. The spacing between two adjacent separation plates 12 is the same as that of holes 111.

Figure 4:
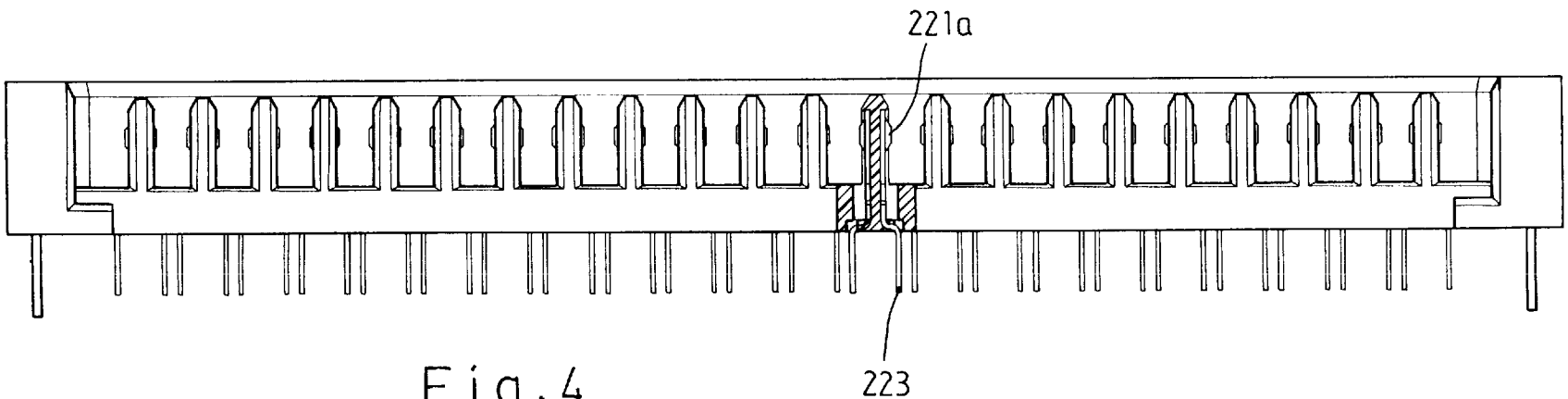
FIG. 4 is a front view of board connector of main board shown in FIG. 2B.

Further, the gap between two adjacent separation plates 12 is the same as the number of holes 111. Each separation plate 12 is corresponding to hole 111 of the same column. That is, holes 111 of the same column are received in the spacing of the corresponding separation plate 12. Two identical terminals 13 are received in the spacing in a stack configuration. Terminal 13 comprises an engagement portion 132 inserted into the hole 111 and an insertion portion 131 wherein engagement portion 132 is a U-shaped member having two elastic vertical opposed portions as claws 132*a* and 132*b* to secure to the hole 111 and two lateral tabs 132*c* for securing in the body of adapter 1. Insertion portion 131 is extended outward from drive one claw 132*b*. As such, insertion portion 131 of upper terminal 13 is opposed to insertion portion 131 of lower terminal 13 in the same elevation when insertion portions 131 are urged against the wall of separation plate 12. An outward bend 131*a* is formed in front of insertion portion 131. The front end of bend 131*a* urges against the tip of separation plate 12 (FIG. 3) to form a slant guiding surface for facilitating insertion. Connector 2 of main board is an elongate member open to two adjacent sides (i.e., top and front sides) thereof thus having an L-shaped cross-section. A plurality of equally spaced apart vertical plates 21 are provided in the recessed portion of connector 2. Two opposed grooves 211 are provided on the walls of vertical plate 21 for receiving the upper plates 221 of terminals 22. Terminals 22 are received in the spacing between two adjacent vertical plates 21. Two terminals 22 are identical each other. Each terminal 22 comprises an inverted L-shaped post 223 extended down from drive the body of connector 2 being fixed to main board, an upper plate 221 for urging against insertion portion 131 of adapter 1, and a central connection portion 222 attached between post 223 and upper plate 221. Upper plate 221 is a rectangular piece having a raised point 221*a* formed by punching (FIG. 4). Raised point 221*a* of upper plate 221 is protruded toward vertical plate 21. Terminals 22 are inserted from drive bottom toward top into the body of connector 2. Upper plate 221 is secured in groove 211. Connection portion 222 is also secured in a recess (not shown) of connector 2 for preventing terminal 22 from drive being separated. Two tabs 222*a* and 222*b* are protruded from sides of connection portion 222 for enhancing the engagement.

Figure 5:
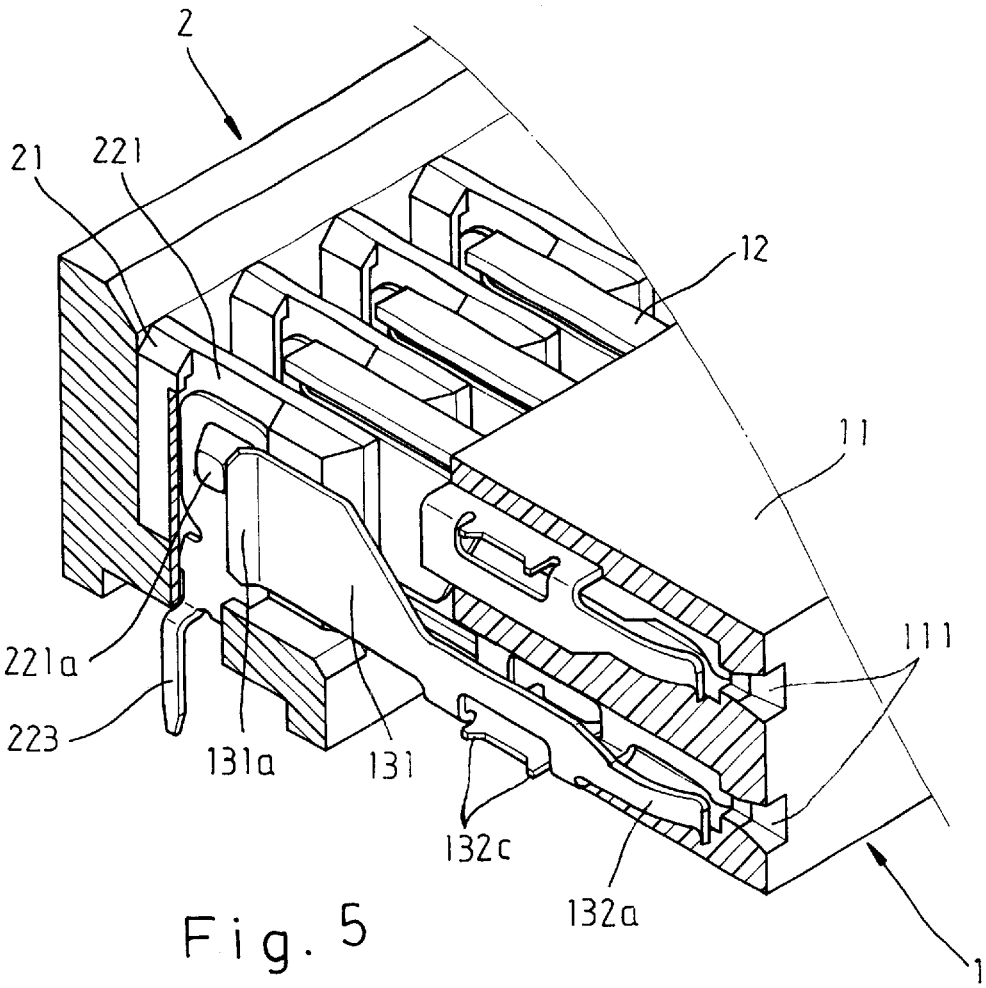
FIG. 5 is a perspective view in part section showing the attachment of terminals of adapter for connector of hard disk drive/CD-ROM drive and board connector of main board.
Figure 6:
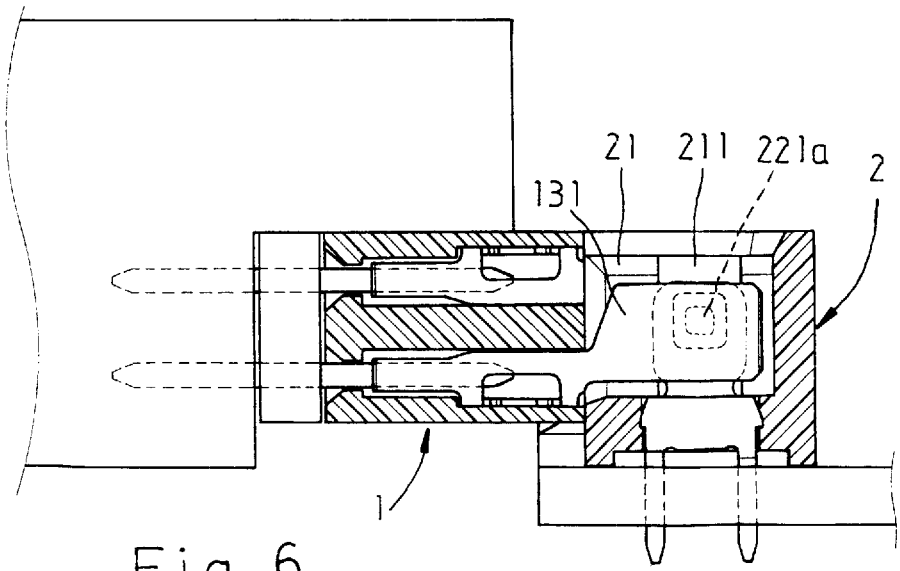
FIG. 6 is sectional view showing the attached terminals of adapter for connector of hard disk drive/CD-ROM drive and board connector of main board.

FIGS. 5 and 6 illustrate the attachment of adapter for connector 1 of hard disk drive/CD-ROM drive and board connector 2 of main board. It is designed that adapter for connector 1 of hard disk drive/CD-ROM drive can be attached in a range of about 90 degrees with respect to connector 2 of main board. As such, separation plate 12 of adapter 1 is inserted into the spacing between two adjacent vertical plates 21 of connector 2. Then insertion portions 131 are urged against raised points 221*a* of upper plates 221. Bends 131*a* of insertion portions 131 are pressed to straighten by raised points 221*a*. As such, insertion portions 131 are tightly engaged with the walls of separation plate 12. This can lower the contact resistance to a minimum because the expansion force of elastic terminals 13 exerts on terminals 22. Moreover, adapter for connector 1 of hard disk drive/CD-ROM drive still can move with respect to connector 2 of main board within above range after attached. This facilitates the convenience of assembly and disassembly.

While the invention herein disclosed has been described by means of specific embodiments, numerous modifications and variations could be made thereto by those skilled in the art without departing from drive the scope of the invention set forth in the claims.

What is claimed is:

1. An adapter in combination with a board connector of a main board, comprising:

an adapter main body with a plurality of equally spaced first plates protruding from a front side of said adapter main body, a rear side of said adapter main body comprising two rows of equally spaced holes, spacing between adjacent ones of said first plates being the same as that of adjacent ones of said holes, and a number of gaps between adjacent ones of said first plates being equal to a number of said holes in each row of said holes;

a plurality of identical first terminals arranged in stacked pairs, said first terminals each comprising an engagement portion and an insertion portion, said insertion portions being inserted between said adjacent ones of said first plates and into corresponding holes;

said board connector of said main board is an elongate member open on two adjacent sides thereof, said board connector comprises a plurality of equally spaced second plates situated in a recessed portion of said board connector of said main board, said recessed portion being open on said two adjacent sides, each of said second plates includes a pair of opposing terminal seats, a plurality of pairs of second terminals being received in said terminal seats, each of said second terminals comprising an inverted L-shaped post extended downward from said board connector of said main board, an upper plate that contacts said insertion portions of said first plates, and a central connection portion provided in said board connector of said main board that is attached between said L-shaped post and said upper plate, each said upper plate being rectangular and having a raised point secured in said recessed portion of each said second plate; whereby said insertion portions of said first terminals are engaged with upper portions of said second terminals when each of said first plates of said adapter are inserted into spaces between adjacent pairs of said second plates of said board connector of said main board, such that said adapter is electrically connected to said board connector of said main board, and said adapter is movable through a range of 90 degrees with respect to said board connector of said main board.

2. The adapter of claim 1, wherein:

said insertion portion further comprises a front outward bent section contacting a front of each said first plate to form a slanted guiding surface.

3. The adapter of claim 1, wherein:

said engagement portion of each of said first terminals is U-shaped and has two elastic opposed claws to secure said first terminals in said holes.

4. The adapter of claim 1, wherein:

each of said first plates is I-shaped.

5. An adapter in combination with a board connector of a main board, comprising:

an adapter main body with a plurality of equally spaced first plates protruding from a front side of said adapter main body, a rear side of said adapter main body comprising two rows of equally spaced holes, spacing between adjacent ones of said first plates being the same as that of adjacent ones of said holes, and a number of gaps between adjacent ones of said first plates being equal to a number of said holes in each row of said holes;

a plurality of identical first terminals arranged in stacked pairs, said first terminals each comprising an engagement portion and an insertion portion, said insertion portions each comprising a front outward bent section contacting a front of each said first plate to form a slanted guiding surface, said insertion portions being inserted between said adjacent ones of said first plates and into corresponding holes;

said board connector of said main board is an elongate member open on two adjacent sides thereof, said board connector comprises a plurality of equally spaced second plates situated in a recessed portion of said board connector of said main board, said recessed portion being open on said two adjacent sides, each of said second plates includes a pair of opposing terminal seats, a plurality of pairs of second terminals being received in said terminal seats, each of said second terminals comprising an inverted L-shaped post extended downward from said board connector of said main board, an upper plate that contacts said insertion portions of said first plates, and a central connection portion provided in said board connector of said main board that is attached between said L-shaped post and said upper plate, each said upper plate being rectangular and having a raised point secured in said recessed portion of each said second plate; whereby said insertion portions of said first terminals are engaged with upper portions of said second terminals when each of said first plates of said adapter are inserted into spaces between adjacent pairs of said second plates of said board connector of said main board, such that said adapter is electrically connected to said board connector of said main board, and said adapter is movable through a range of 90 degrees with respect to said board connector of said main board.

* * * * *